US009751091B2

(12) United States Patent
Chi et al.

(10) Patent No.: US 9,751,091 B2
(45) Date of Patent: Sep. 5, 2017

(54) SYSTEMS AND METHODS FOR SEPARATING METALLIC AND NONMETALLIC PARTICLES IN A MIXED-PARTICLE SUSPENSION

(71) Applicant: The Johns Hopkins University, Baltimore, MD (US)

(72) Inventors: Su Chih Chi, Towson, MD (US); Robert Cammarata, Columbia, MD (US); Stephen L. Farias, Baltimore, MD (US); Donglei Fan, San Jose, CA (US); Danru Qu, Baltimore, MD (US); Chia-Ling Chien, Cockeysviile, MD (US)

(73) Assignee: THE JOHNS HOPKINS UNIVERSITY, Baltimore, MD (US)

( * ) Notice: Subject to any disclaimer, the term of this patent is extended or adjusted under 35 U.S.C. 154(b) by 0 days.

(21) Appl. No.: 13/902,191

(22) Filed: May 24, 2013

(65) Prior Publication Data

US 2014/0346044 A1 Nov. 27, 2014

(51) Int. Cl.

| | |
|---|---|
| ***B03C 7/02*** | (2006.01) |
| ***B03C 5/00*** | (2006.01) |
| ***B03C 5/02*** | (2006.01) |

(52) U.S. Cl.

CPC ..... *B03C 7/023* (2013.01); *B03C 5/005* (2013.01); *B03C 5/026* (2013.01)

(58) Field of Classification Search

CPC ..... B01F 13/001; B01C 5/00–5/028

(Continued)

(56) References Cited

U.S. PATENT DOCUMENTS

| | | | |
|---|---|---|---|
| 7,161,107 | B2 | 1/2007 | Krupke et al. |
| 8,097,141 | B2 | 1/2012 | Schmidt et al. |

(Continued)

FOREIGN PATENT DOCUMENTS

| | | | |
|---|---|---|---|
| JP | 2009-014342 | A | 1/2009 |
| JP | 2010-269979 | A | 12/2010 |
| KR | 10-2009-0006912 | A | 1/2009 |

OTHER PUBLICATIONS

Stogryn (IEEE transactions on microwave theory and techniques, Aug. 1971, pp. 733-736).*

(Continued)

*Primary Examiner* — Luan Van
*Assistant Examiner* — Steven E Rosenwald
(74) *Attorney, Agent, or Firm* — Venable LLP; Henry J. Daley; Laura G. Remus

(57) ABSTRACT

A continuous flow particle separation system for separating metallic and nonmetallic particles from a mixed-particle suspension includes a fluid channeling component defining an input channel and first and second output channels fluidly connected to the input channel at a bifurcated junction, a first electrode and a second electrode arranged proximate the input channel at least partially prior to the bifurcated junction, and an alternating current (AC) electric power source electrically connected to the first and second electrodes. The first and second electrodes have shapes configured to provide a spatially-gradient electric field across the input channel, and the AC electric power source is configured to provide an AC electric potential to the first and second electrodes to cause a separation of the metallic and nonmetallic particles by dielectrophoresis due to a difference in dielectrophoretic forces imposed on the metallic particles relative to those of the nonmetallic particles such that first output fluid flow in the first output channel has an enriched concentration of metallic particles and second output fluid (Continued)

flow in the second output channel has an enriched concentration of nonmetallic particles relative to the mixed-particle suspension in said input channel.

15 Claims, 13 Drawing Sheets

(58) Field of Classification Search
USPC ..... 204/547, 643
See application file for complete search history.

(56) References Cited

U.S. PATENT DOCUMENTS

| | | | | |
|---|---|---|---|---|
| 2007/0125941 | A1 | 6/2007 | Lee et al. | |
| 2008/0217179 | A1 | 9/2008 | Xi et al. | |
| 2009/0026080 | A1* | 1/2009 | Han et al. | 204/545 |
| 2010/0044227 | A1 | 2/2010 | Kim et al. | |
| 2010/0101983 | A1 | 4/2010 | Butler et al. | |
| 2011/0311791 | A1 | 12/2011 | Chien et al. | |
| 2012/0281213 | A1* | 11/2012 | Tyler et al. | 356/301 |

OTHER PUBLICATIONS

Chapter 14 by Hughes in Handbook of Nanoscience, Engineering, and Technology Edited by Sergey Edward Lyshevski, Gerald J. lafrate, William A. Goddard, and Donald W Brenner CRC Press 2003.*
Fuhrer et al., Electronic Properties of Molecular Nanostructures, edited by H. Kuzmany et al., © 2001 American Institute of Physics, pp. 401-404.*
Pohl et al. (J. BioL Phys. Volume 6, 1978).*
Morgan et al. (J. Electrostatics, 42, 1997, 279-293).*
Zehe et al. (Biophysics, 2006, vol. 51, No. 4, pp. 645-653).*
Castellanau et al. (Biophysical Journal, vol. 91, 2006, pp. 3937-3945).*
Gunda et al. (Biomicrofluidics 4, 014105 2010).*
Xu et al. (IEEE Transactions on nanotechnology, vol. 8, No. 4, 2009).*
Jones (Electromechanics of Particles, Thomas B. Jones, Cambridge University Press 1995).*
International Search Report and Written Opinion issued in PCT Application No. PCT/US2014/038827 dated Sep. 26, 2014.
Office Action issued in U.S. Appl. No. 14/220,009 dated Jun. 26, 2014.
Stogryn, "Equations for Calculating the Dielectric Constant of Saline Water," IEEE Transactions on Microwave Theory & Techniques, Aug. 1971, pp. 733-736.
Avouris and J. Appenzeller, *The Industrial Physicist*, Jun./Jul. 2004, American Institute of Physics.
Avouris, *Physics World* 20, 40-45 (Mar. 2007).
Dresselhaus and P.C. Eklund, *Adv. Phys.*, 705-814 (2000).
Dresselhaus et al., *Carbon* 40, 2043-2061 (2002).
Dresselhaus et al., *Physics Reports* 409, 47-99 (2005).
Dresselhaus, G. Dresselhaus and M. Pimenta, *Eur. Phys. J.* D 9, 69-75 (1999).
Dresselhaus, *Raman Scattering in Carbon Nanotubes* (2005). Website: nanotube.msu.edu/ni05/abstracts/NT05tutor-Dresselhaus.pdf
Fan et al., Electronic Properties of nanoentities revealed by electrically driven rotation. *Proceedings of the National Academy of Sciences* 109, 9309-13 (2012).
Jorio et al., *Phys. Rev. Lett.* 86, 1118-1121 (2001).
Kim and C. S. Han, *Nanotechnology* 16, 2245-2250 (2005).
Kim et al., "Magnetic nanoparticles-based separation of metallic and semiconducting carbon nanotubes," Nanotechnology, 2011, vol. 22, 045703, pp. 1-6.
Krupke et al., "Separation of Metallic from Semiconducting Single-Walled Carbon Nanotubes," Science, 2003, vol. 301, pp. 344-347
Krupke et al., Nano Lett. 3, 1013-1023 (2003).
Lee et al., Appl. Phys. A 80, 5-8 (2005).
Lutz et al., "(Macroscopic scale separation of metallic and semiconducting nanotubes by dielectrophoresis," Carbon, 2005, vol. 4, pp. 2508-2513.
Maeda et al., "Dispersion and Separation of Small-Diameter Single-Walled Carbon Nanotubes," J. Am. Chem. Soc, 2006, vol. 128, pp. 12239-12242.
Maeda et al., "Large-Scale Separation of Mettalic and Semiconducting Single-Walled Carbon Nanotubes," J. Am. Chem. Soc, 2005, vol. 127, pp. 10287-10290.
Morgan and N. G. Green, J. Electrostatics 42, 279-293 (1997).
Peng et al., J. Appl. Phys. 100, 024309 (2006)
Pimenta et al., *Phys. Rev. B* 58, R16016-16019 (1998).
Sauvajol et al., Carbon 40, 1697-1714 (2002).
Shin et al., "Continuous Extraction of Highly Pure Metallic Single-Walled Carbon Nanotubes in a Microfluidic Channel," Nano Letters, 2008, vol. 8, pp. 4380-4385.
Tanaka et al., Appl. Phys. Expr. 1, 114001 (2008).
Website: http://www/photon.t.u-tokyo.ac.jp/~maruyama/kataura/kataura2n.pdf.
Wei et al., Diamonds and Related Materials 19, 573-577 (2010).
Wejinya et al., 2007 IEEE/ASME International Conference on Advanced Intelllgent Mechatronics. pp. 1-6 (2007).
Doorn et al., J. Phys. Chem. B, 2003, 107, 6063-6069.
Heller et al., J. Am. Chem. Soc., 2004, 126, 14567-14573.
Office Action issued in U.S. Appl. No. 14/220,009 dated Dec. 15, 2014.
Office Action issued in U.S. Appl. No. 14/220,009 dated Jun. 26, 2015.
Bachtold et al., "Scanned Probe Microscopy of Electronic Transport in Carbon Nanotubes," Physics Review Letters, vol. 84, 2000, pp. 6082-6085.
Kang et al., "Dielectrophoretic separation of metallic arc-discharge single-walled carbon nanotubes in a microfluidic channel," Synthetic Metals. 184, 23-28 (2013).
Kim et al, "Dielectrophersis of Surface Conductance Modulated Single-Walled Carbon Nanotubes Using Catanionic Surfactants," Journal of Phy. Chem. B. 110, 1541-1545 (2006).
Kong et al, "Quantum Interference and Ballistic Transmission in Nanotube Electron Waveguides," Physics Review Letters 87, 106801 (2001).
Krupke et al, "Separation of Metallic from Semiconducting Single-Walled Carbon Nanotubes," Science 301, 344-347 (2003).
Krupke et al, "Surface Conductance Induced Dielectrophoresis of Semiconducting Single-Walled Carbon Nanotubes," Nano Letters 4, 1395-1399 (2004).
Javey et al., "High-K dielectrics for advanced carbon-nanotube transistors and logic gates," Nature Materials, vol. 1, 2002, pp. 241-246.
Lutz et al., "Macroscopic scale separation of metallic and semiconducting nanotubes by dielectrophoresis," Carbon 43, 2508-2513 (2005).
Peng et al, "Dielectrophoresis Field Flow Fractionation of Single-Walled Carbon Nanotubes," JACS Communications. 128, 8396-8397 (2006).
Shin et al, "Continuous Extraction of Highly Pure Metallic Single-Walled Carbon Nanotubes in a Microfluidic Channel," Nano Letters. 8, 4380-4385 (2008).

* cited by examiner

Black points are semiconductor nanotubes
Red points are metallic nanotubes

SYSTEMS AND METHODS FOR SEPARATING METALLIC AND NONMETALLIC PARTICLES IN A MIXED-PARTICLE SUSPENSION

BACKGROUND

1. Field of Invention

The field of the currently claimed embodiments of this invention relates to systems and methods for separating metallic and nonmetallic particles in a mixed-particle suspension.

2. Discussion of Related Art

Since the success of integrated silicon technology of the metal oxide semiconductor field-effect transistor (MOSFET), the ability to scale down the dimensions of the device has been the key to improving speed and energy efficiency[1-2]. However, the industry generally expects that fundamental material barriers will limit the size reduction of current nanoscale MOSFET devices and that this road block to continuing advancement will arrive within a decade as predicted by Moore's law[2]. In order to overcome these barriers, new materials are needed to solve the scalability problems of future silicon devices. Among these new silicon substitute materials, single-walled carbon nanotubes (SWCNTs) have become excellent candidates as building blocks for future nanoscale electronics due to their small size and unique electrical properties. SWCNTs have been actively pursued as electronic materials and silicon device substitutes since Ijima and Bethune independently discovered them in 1993[1-4]. However, current SWCNT production techniques generate a mixture of two types of nanotubes with divergent electrical behaviors. Some of the nanotubes act as metallic materials, while others display semiconducting properties. This random mixture has complicated the realization of functional carbon nanotube-based nanoelectronics[3,5-6]. SWCNTs can be considered to be a single rolled-up graphene sheet[7]. Variability during production of SWCNTs leads to tubes of different diameter and atomic configuration relative to the tube axis (degree of chirality)[2,7]. These structural variations dictate the electronic properties of SWCNTs and can result in metallic or semiconducting nanotubes.

Current commercial processes for SWCNT separation require ultra-centrifugation and require large amounts of time, energy, and equipment to run. Significant research has been conducted on using dielectrophoresis (DEP) as an alternative means of purification, but the state of the art techniques demonstrated by to date are significantly handicapped. Conventional DEP separation devices and techniques are static systems and only pull metallic nanotubes onto the device surface, leaving semiconducting and some metallic tubes in suspension. These devices only handle small fixed-volumes of mixed SWCNT and the working areas of the devices are cluttered by nanotubes after each pass. Only the metallic nanotubes deposited at the electrode can be extracted with high purity. The remaining suspension is still a mixture and removing this excess volume can result in contamination of the high purity surface. There thus remains a need for improved systems and methods for separating metallic and nonmetallic particles in a mixed-particle suspension.

SUMMARY

A continuous flow particle separation system for separating metallic and nonmetallic particles from a mixed-particle suspension according to an embodiment of the current invention includes a fluid channeling component defining an input channel and first and second output channels fluidly connected to the input channel at a bifurcated junction, a first electrode and a second electrode arranged proximate the input channel at least partially prior to the bifurcated junction, and an alternating current (AC) electric power source electrically connected to the first and second electrodes. The first and second electrodes have shapes configured to provide a spatially-gradient electric field across the input channel, and the AC electric power source is configured to provide an AC electric potential to the first and second electrodes to cause a separation of the metallic and nonmetallic particles by dielectrophoresis due to a difference in dielectrophoretic forces imposed on the metallic particles relative to those of the nonmetallic particles such that first output fluid flow in the first output channel has an enriched concentration of metallic particles and second output fluid flow in the second output channel has an enriched concentration of nonmetallic particles relative to the mixed-particle suspension in said input channel.

A particle separation system for separating metallic and nonmetallic particles from a mixed-particle suspension according to an embodiment of the current invention includes a fluid containment component defining a fluid containment region for containing at least a portion of the mixed-particle suspension, a first electrode and a second electrode arranged proximate the fluid containment region, and an alternating current (AC) electric power source electrically connected to the first and second electrodes. The first and second electrodes have shapes configured to provide a spatially-gradient electric field across the fluid containment region. The AC electric power source is configured to provide an AC electric potential to the first and second electrodes to cause a separation of the metallic and nonmetallic particles by dielectrophoresis due to a difference in dielectrophoretic forces imposed on the metallic particles relative to those of the nonmetallic particles, and the AC electric power source is configured to provide an AC electric potential such that a force imposed on the metallic particles by the dielectrophoresis is opposite in direction to a force imposed on the nonmetallic particles by the dielectrophoresis to provide an enriched concentration of metallic particles proximate one of the first and second electrodes and an enriched concentration of nonmetallic particles proximate the other one of the first and second electrodes relative to the mixed-particle suspension.

A continuous-flow method for separating metallic and nonmetallic particles from a mixed-particle suspension according to an embodiment of the current invention includes providing an input flow of a mixed-particle fluid suspension in an input channel, the input channel being bifurcated into first and second output channels at a bifurcated junction; applying a spatially-gradient and time-varying electric field to the input flow of the mixed-particle fluid suspension in the input channel to impose dielectrophoretic forces on metallic and nonmetallic particles in the mixed-particle fluid suspension; and collecting a metallic-particle rich fluid suspension from the first output channel and a nonmetallic-particle rich fluid suspension from the second output channel. The spatially-gradient and time-varying electric field is selected to have a time variation such that a dielectrophoretic force imposed on the metallic particles is different from a dielectrophoretic force imposed on the nonmetallic particles.

A method for separating metallic and nonmetallic particles from a mixed-particle suspension according to an embodiment of the current invention includes providing a mixed-particle fluid suspension, and applying a spatially-gradient and time-varying electric field to the mixed-particle fluid suspension to impose dielectrophoretic forces on metallic and nonmetallic particles in the mixed-particle fluid suspension. The spatially-gradient and time-varying electric field is selected to have a time variation such that a dielectrophoretic force imposed on the metallic particles is opposite in direction from a dielectrophoretic force imposed on the nonmetallic particles.

BRIEF DESCRIPTION OF THE DRAWINGS

Further objectives and advantages will become apparent from a consideration of the description, drawings, and examples.

DETAILED DESCRIPTION

Figure 1A:
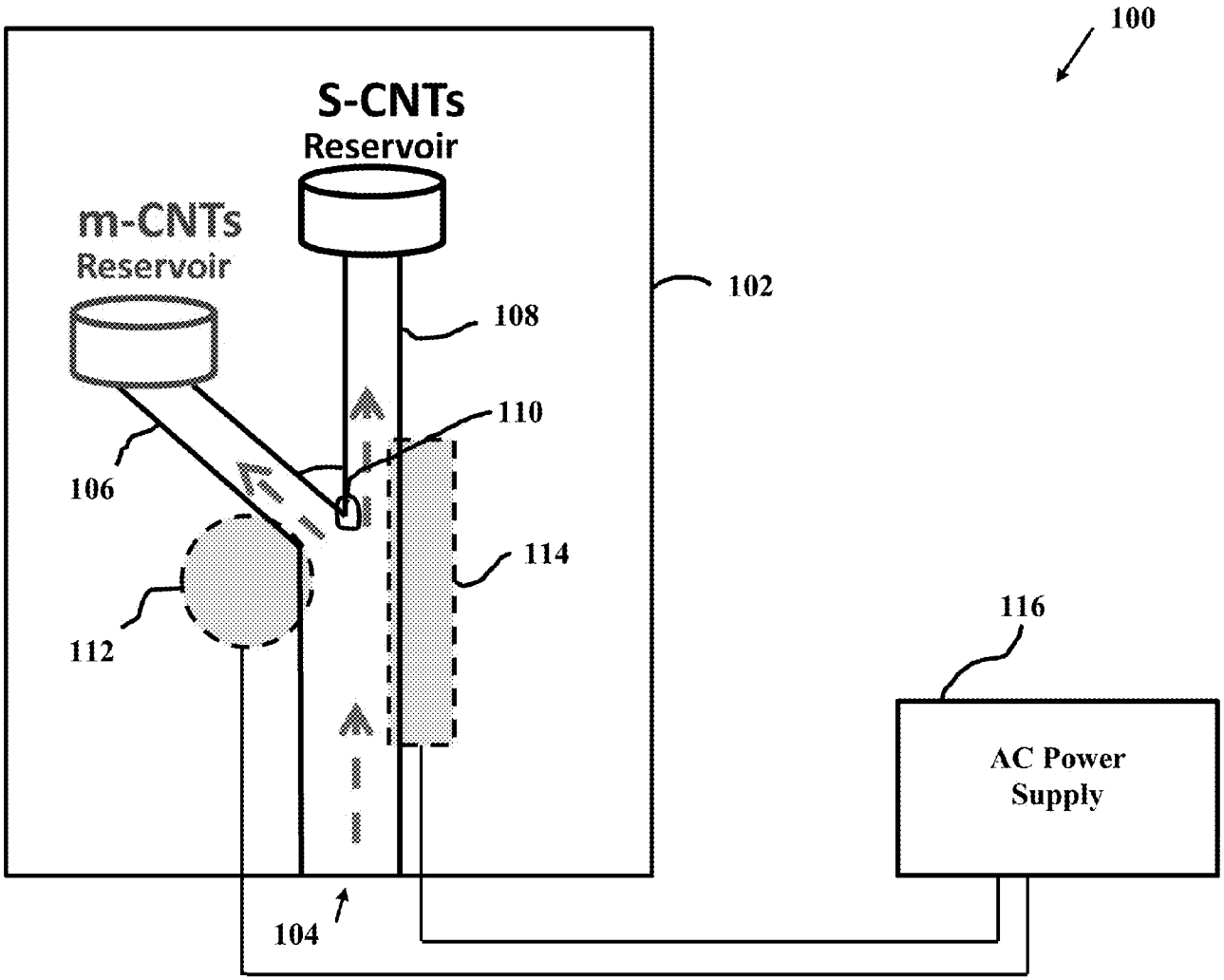
FIG. 1A is a schematic illustration of a continuous flow particle separation system for separating metallic and nonmetallic particles from a mixed-particle suspension according to an embodiment of the current invention.

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Some embodiments of the current invention can provide a low cost, low energy fluidic device that can separate metallic SWCNTs from semiconducting ones from an initially random mixture of SWCNTs in suspension using AC dielectrophoresis. A dynamic flow system according to an embodiment of the current invention can allow for continuous feeding and separation of mixed SWCNTs. It has been demonstrated at industrially relevant processing rates. This technique can extract metallic SWCNTs from semiconducting ones due to the difference in magnitude and/or direction of dielectrophoretic forces experienced by the two types. The significant force difference comes from a very large absolute dielectric constant of metallic SWCNTs and the low value of a dielectric constant of semiconducting SWCNTs reported by Krupke and his co-workers[3].

Some embodiments of the current invention are unique and substantially improved from other related work for at least the following reasons: (1) The use of AC electric field schemes (frequency, amplitude, and unique geometry) to drive nanoparticles of different electronic properties in opposite directions within the suspension. Both metallic and semiconducting SWCNTs are moved, unlike conventional approaches that are limited to pulling metallic nano-particles out of suspension. (2) Some embodiments of the current invention do not require driving the SWCNTs to a surface, or centrifugation, so we can carry out the separation in a continuous flow process allowing for bulk, batch processing.

Dielectrophoresis (DEP) is an electro-kinetic phenomenon where a non-uniform electric field induces polarization in a neutrally charged particle and causes motion of the induced dipole[8]. The dielectrophoretic force exerted on a polarized particle in a nonuniform electric field in suspension can be written as:

$$F_{DEP}=(p\cdot\nabla)E \quad [1]$$

where p is the induced dipole moment and E is the electric field. In an AC field, the polarized particle exhibits frequency dependent behavior[9,25]. Here we approximate a long and thin carbon nanotube as a prolate ellipsoid. The DEP force can be represented by:

$$F_{DEP}=\frac{\pi r^2 l}{2}\varepsilon_m Re(K)\nabla|E|^2 \quad [2]$$

$$K=\frac{\epsilon_p^*-\epsilon_m^*}{\epsilon_m^*+L(\epsilon_p^*-\epsilon_m^*)} \quad [3]$$

$$\epsilon^*=\epsilon-\frac{i\sigma}{\omega};\ L=\frac{\ln(l/r)-1}{(l/2r)^2}$$

-continued $$Re(K) = \frac{\epsilon_p\epsilon_m + L\epsilon_p^2 - \epsilon_m^2 + \frac{\sigma_p\sigma_m - \sigma_m^2 + L\sigma_p^2}{\omega^2}}{(\epsilon_m + L\epsilon_p)^2 + \left(\frac{L\sigma_p + \sigma_m}{\omega}\right)^2} \quad [4]$$

where K is known as the Clausius-Mossotti factor, $\in^*$ is the complex dielectric constant, $\epsilon$ is the permittivity, $\sigma$ is the conductivity, L is the shape factor, l is the length of the particle, r is the radius of the particle, and $i=\sqrt{1}$. The subscript m refers to the medium in which a particle is suspended and the subscript p refers to the particle itself.

The equation of a translational motion of a SWCNT (modeled as a prolate ellipsoid) in a viscous medium is governed by Newton's second law:

$$m_{CNT}\frac{dV_{CNT}}{dt} = F_{DEP} + f(v_{CNT} - v_m), \quad [5]$$

where $m_{CNT}$ is the mass of a SWCNT, $v_{CNT}$ is the translational velocity of a SWCNT, f is the fraction factor which depends on the particle geometry and the fluid viscosity, and $v_m$ is the velocity of the viscous medium. The solution of equation [5] was developed by Morgan and Green[15]. When the initial SWCNT velocity is zero, the velocity of a SWCNT can be taken as:

$$v_{CNT} = \left(\frac{F_{DEP}}{f} + v_m\right)\left(1 - e^{-\frac{f}{m_{CMT}}t}\right) \quad [6]$$

Since for a nanosized particle, the characteristic time, $$\tau\left(=\frac{m_{CNT}}{f}\right),$$

is a very small number. The velocity of a SWCNT in a viscous medium is given by $$v_{CNT} \approx \left(\frac{f_{DEP}}{f} + v_m\right) \quad [7]$$

For two particles with the same geometry, in the same medium, and under the same electric field conditions, any difference in direction and magnitude of the DEP force is determined by Re(K), the real part of the Claussius-Mossotti factor. At high frequencies ($\omega$), the Claussius-Mossotti factor is determined by the permittivity of different types of SWCNTs and the medium[9-13]. One can evaluate Re(K) and the DEP force in the high frequency limit, $$\lim_{\omega\to\infty} Re(K) = \frac{\epsilon_p\epsilon_m + L\epsilon_p^2 - \epsilon_m^2}{(\epsilon_m + L\epsilon_p)^2} \quad [8]$$

$$\lim_{\omega\to\infty} F_{DEP} = \frac{\pi r^2 l}{2}\epsilon_m\frac{\epsilon_p\epsilon_m + L\epsilon_p^2 - \epsilon_m^2}{(\epsilon_m + L\epsilon_p)^2}\nabla|E|^2 \quad [9]$$

Therefore, depending on the polarizability of a nanostructure compared to that of the medium, the electrophoretic force could push the nanotubes toward the high electric field density region (positive dielectrophoresis) or the low electric field density region (negative dielectrophoresis)[13-16]. By tuning the AC field to a particular frequency, it is possible to drive the metallic tubes in the direction of the electric field gradient while simultaneously driving the semiconducting tubes against the field gradient resulting in segregation of the mixture. The gradient of the electric field in this experiment is generated by the non-uniform shape of the electrodes.

At sufficiently large AC driving frequencies, Re(K) will be positive for $\in_p\in_m + L\in_p^2 \geq \in_m^2$ and negative for $\in_p\in_m + L\in_p^2 < \in_m^2$.

The following table lists example permittivities and conductivities for particles in an aqueous solution. Here $\in_0$ is the permittivity of free space ($8.85\times10^{-12}$ F/m).

| Material | Permittivity ($\in\in_0$) (F/m) | Conductivity ($\sigma$) (1/[Ohm-m]) |
|---|---|---|
| Water with SDS surfactant | $80\in_0$ | $10^{-3}$ |
| Metallic SWCNT | $5000\in_0$ | $10^8$ |
| Semiconducting SWCNT | $2.5\in_0$ | $10^4$ |

From these relative permittivities we can clearly see that as $\omega\to\infty$, the Re(K) for the metallic nanotube will be positive and the Re(K) for the semiconducting nanotube will be negative (for $L=10^{-5}$). This will lead to a positive DEP force on the metallic tubes and a negative DEP force on the semiconducting tubes.

If Re(K) crosses 0, the crossover frequency can be defined as:

$$\omega_{cross} = \sqrt{\frac{\sigma_p\sigma_m + L\sigma_p^2 - \sigma_m^2}{\epsilon_m^2 - \epsilon_p\epsilon_m - L\epsilon_p^2}} \quad [10]$$

One important note is that the medium can be changed to adjust the permittivity and conductivity AND the conductivity of the semiconducting SWCNTs is highly dependent on the environment around the tube. An isolated perfect semiconducting SWCNT in vacuum will have a theoretical conductivity of 0 but exposing it to a chemical environment adds states available for conduction. $10^4$ is the conductivity we have assigned to the semiconducting tubes as an example value for a solution.

FIG. 1A provides a schematic illustration of a continuous flow particle separation system 100 for separating metallic and nonmetallic particles from a mixed-particle suspension according to an embodiment of the current invention. The continuous flow particle separation system 100 includes a fluid channeling component 102 defining an input channel 104 and first and second output channels (106, 108) fluidly connected to the input channel 104 at a bifurcated junction 110. The continuous flow particle separation system 100 also includes first electrode 112 and a second electrode 114 arranged proximate the input channel 104 at least partially prior to the bifurcated junction 110. The continuous flow particle separation system 100 further includes an alternating current (AC) electric power source 116 electrically connected to the first and second electrodes (112, 114). The first and second electrodes (112, 114) have shapes configured to provide a spatially-gradient electric field across the input channel 104. The AC electric power source 116 is configured to provide an AC electric potential to said first and second electrodes (112, 114) to cause a separation of the metallic and nonmetallic particles by dielectrophoresis due to a difference in dielectrophoretic forces imposed on the metallic particles relative to those of the nonmetallic particles such that first output fluid flow in the first output channel 106 has an enriched concentration of metallic particles and second output fluid flow in the second output channel 108 has an enriched concentration of nonmetallic particles relative to the mixed-particle suspension in the input channel 104.

Figure 1B:
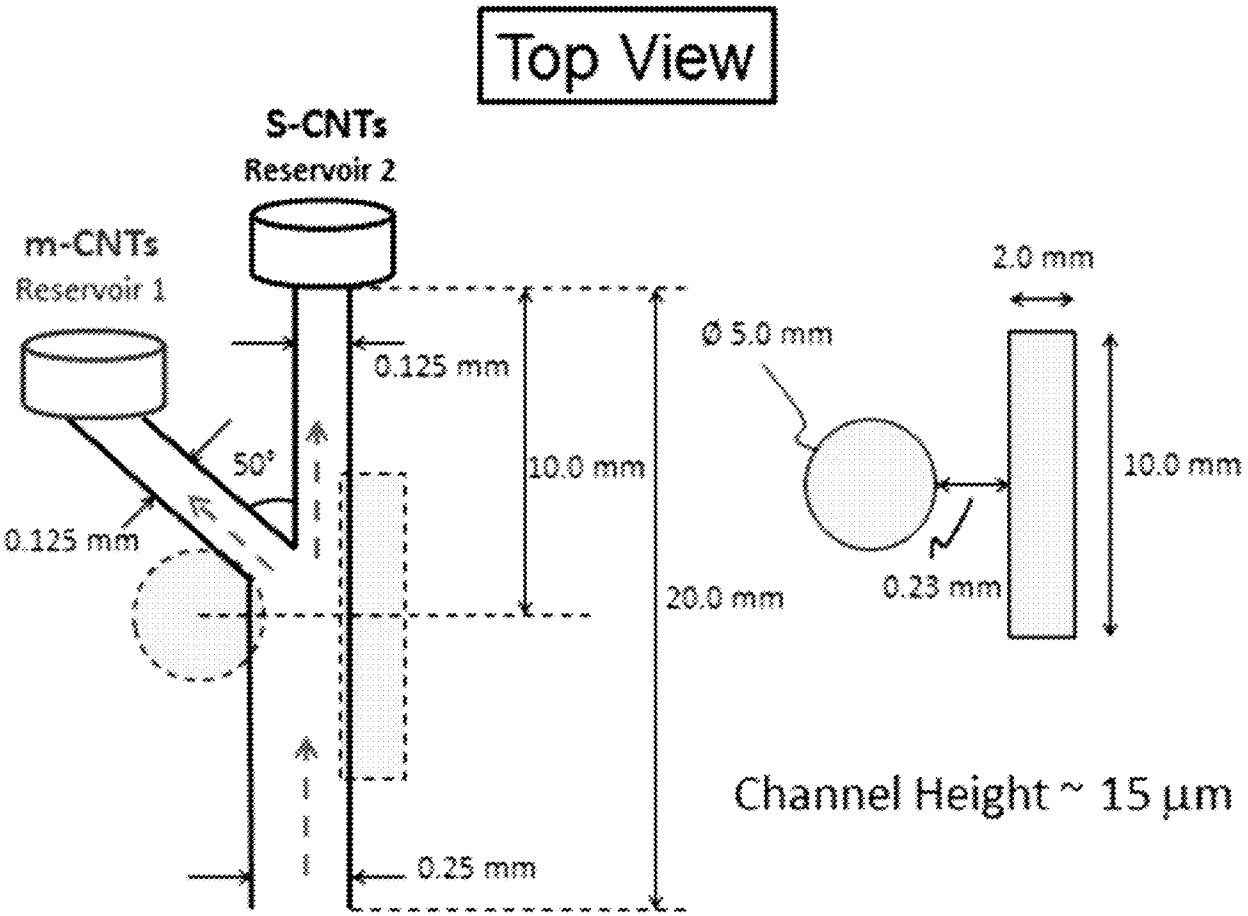
FIG. 1B provides an example of dimensions that can be used for the device of FIG. 1A.

FIG. 1B is a schematic illustration including dimensions for a representative embodiment of the current invention. The general concepts of the current invention are not limited to this particular example and are not limited to the particular dimensions used.

In some embodiments, the fluid can be, or can include, a liquid. However, other fluids can be used according to other embodiments of the current invention.

The first electrode 112 and the second electrode 114 can be arranged at opposing lateral sides of the input channel 104 proximate the bifurcated junction 110, as shown in the example of FIG. 1A. However, the general concepts of the current invention are not limited to only such an arrangement or geometry. The general concepts of the current invention are not limited to particular shapes and/or sizes of the electrodes as long as they provide a gradient electric field. In addition, the general concepts of the current invention are not limited to particular electric field gradients. The design of electrodes to produce greater electric field gradients can be useful in some embodiments to permit the generation of greater DEP forces, for example.

The continuous flow particle separation system 100 is shown with reservoirs for collecting particles from the first output channel 106 and second output channel 108. However, the general concepts of the current invention are not limited to that particular example. The output channels 106 and/or 108 could be connected to other systems or devices for further processing, as desired.

In some embodiments, the input channel 104 defined by the fluid channeling component 102 provides substantially laminar flow of the mixed-particle suspension. The can be useful to avoid re-mixing of separated particles due to turbulent flow. In addition, the first and second output channels (106, 108) defined by the fluid channeling component 102 can also provide substantially laminar flow of the first and second output fluid flows according to some embodiments of the current invention. In some embodiments, the input channel 104 and the first and second output channels (106, 108) defined by the fluid channeling component 102 can be microfluidic channels.

In some embodiments, the AC electric power source 116 can be configured to provide an AC electric potential such that a force imposed on the metallic particles by the dielectrophoresis is opposite in direction to a force imposed on the nonmetallic particles by the dielectrophoresis.

In some embodiments, the input mixed-particle suspension can be a suspension of metallic particles and semiconducting particles in a fluid. In further embodiments, the fluid can have preselected electrical permittivity and/or electrical conductivity, and a frequency of the AC electric potential can be selected based on the preselected electrical permittivity and/or electrical conductivity of the fluid and based on electrical permittivity and electrical conductivity of each of the metallic and semiconducting particles.

In some embodiments, the metallic particles can be metallic carbon nanotubes, and the semiconducting particles can be semiconducting carbon nanotubes.

Figure 2:
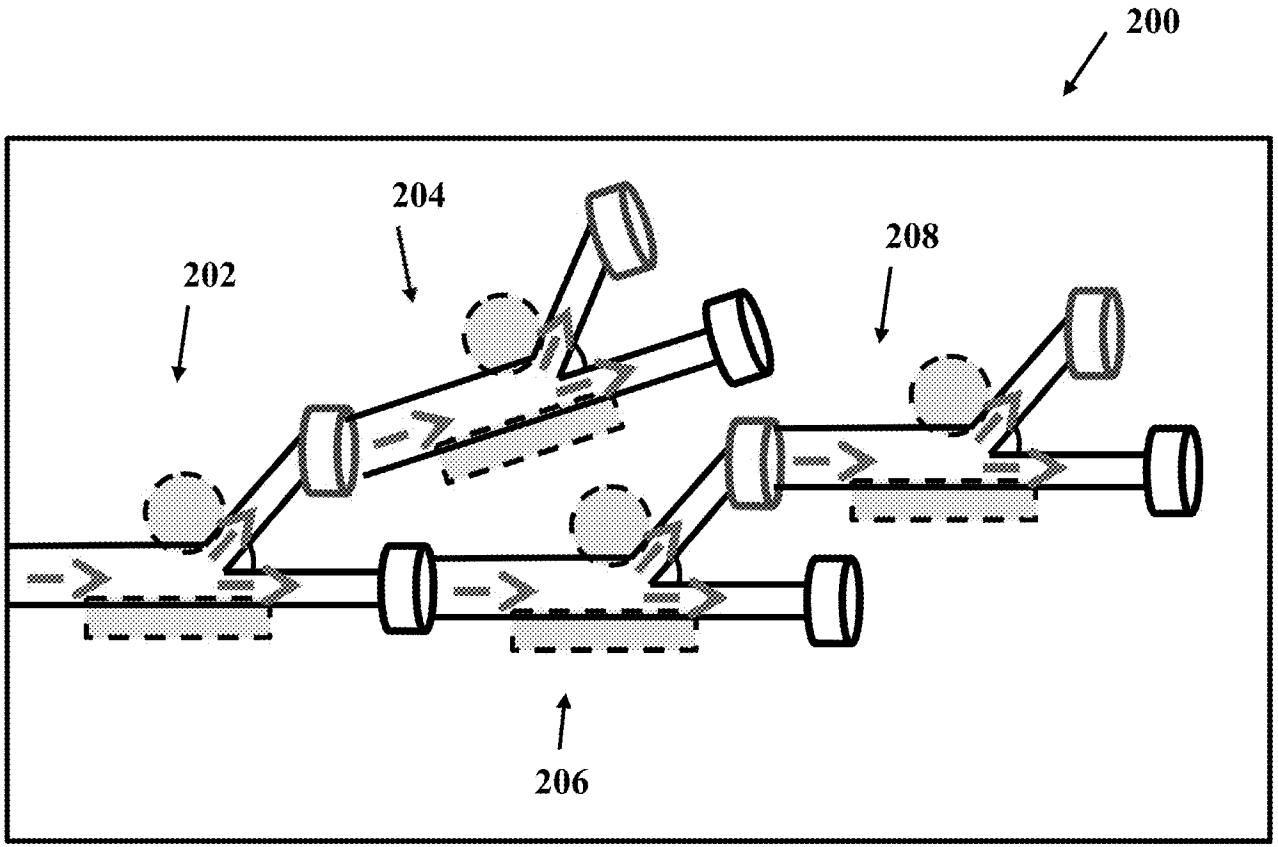
FIG. 2 is a schematic illustration of a multiphase continuous flow particle separation system for separating metallic and nonmetallic particles from a mixed-particle suspension according to an embodiment of the current invention.

FIG. 2 provides a schematic illustration of a continuous flow particle separation system 200 for separating metallic and nonmetallic particles from a mixed-particle suspension according to another embodiment of the current invention. This is an example of a multi-stage continuous flow particle separation system. The power supply (or power supplies) is not shown in FIG. 2. The continuous flow particle separation system 200 has a first stage fluidic structure 202 with corresponding electrodes, second stage fluidic structures 204 and 206, each with corresponding electrodes, and a third stage fluidic structure 208 with corresponding electrodes. Each of the fluidic structures stages can be substantially the same as, or similar to, that of the embodiment of FIG. 1A, for example. The general concepts of the current invention are not limited to any particular number of stages and/or arrangements of the stages. A very large number of alternatives are considered to be within the scope of the current invention.

In order to achieve a certain level of purity in the output channels 106 and 108 of the embodiment of FIG. 1A, one can optimize the relevant parameters such as the frequency of the AC voltage and the electrical properties of the fluid, for example. Alternatively, or in addition, one could include multi-stage separation to optimize the purity of final output streams, as desired.

Another embodiment of the current invention provides continuous-flow method for separating metallic and nonmetallic particles from a mixed-particle suspension. The continuous-flow method includes providing an input flow of a mixed-particle fluid suspension in an input channel, in which the input channel is bifurcated into first and second output channels at a bifurcated junction; applying a spatially-gradient and time-varying electric field to the input flow of the mixed-particle fluid suspension in the input channel to impose dielectrophoretic forces on metallic and nonmetallic particles in the mixed-particle fluid suspension; and collecting a metallic-particle rich fluid suspension from the first output channel and a nonmetallic-particle rich fluid suspension from the second output channel. The spatially-gradient and time-varying electric field is selected to have a time variation such that a dielectrophoretic force imposed on the metallic particles is different from a dielectrophoretic force imposed on the nonmetallic particles.

In some embodiments, the spatially-gradient and time-varying electric field can be selected to have a time variation such that the dielectrophoretic force imposed on the metallic particles is opposite in direction to the dielectrophoretic force imposed on the nonmetallic particles.

In some embodiments, a fluid of the mixed-particle fluid suspension can be selected based on an electrical permittivity and/or electrical conductivity of the fluid. In some embodiments, the fluid of the mixed-particle fluid suspension can be produced to have at least one of a selected electrical permittivity or electrical conductivity. For example, additives could be mixed with a liquid for use in preparing the mixed-particle fluid suspension in some embodiments.

In some embodiments, the nonmetallic particles can be semiconducting particles. In some embodiments, the metallic particles can be metallic carbon nanotubes and nonmetallic particles can be semiconducting carbon nanotubes.

A method for separating metallic and nonmetallic particles from a mixed-particle suspension according to another embodiment of the current invention includes providing a mixed-particle fluid suspension, and applying a spatially-gradient and time-varying electric field to the mixed-particle fluid suspension to impose dielectrophoretic forces on metallic and nonmetallic particles in the mixed-particle fluid suspension. The spatially-gradient and time-varying electric field is selected to have a time variation such that a dielectrophoretic force imposed on the metallic particles is opposite in direction from a dielectrophoretic force imposed on the nonmetallic particles.

Theoretical DEP Calculations for Optimized SWCNT Separation

The following provides calculations to optimize a separation process for purification of nanoparticles by their electronic properties and geometry using dielectrophoretic (DEP) forces in a continuous flow system according to an embodiment of the current invention. Synthesis of nanostructures typically leads to a dispersion of particle sizes, structures, and properties. Applications utilizing these nanoparticles often require use of particles within a narrow band of properties. Particles outside of this functional property range act as wasted material and can even inhibit the effects of the desired particles. Thus purification of particles in a cost effective fashion is critically important to further advancements and commercialization of nanotechnology. This is especially important when manufacturing a relatively monodispersed set of particles is inherently difficult. In principle, a process according to an embodiment of the current invention can be used on any particles that have divergent electronic or geometric properties. In the following example, we are focused on the specific application of separating single walled carbon nanotubes (SWCNT). We are focusing on this nanostructure because of the potential impact of generating electronically pure SWCNTs at a low cost. Current SWCNT production methods result in mixed batches of metallic and semiconducting tubes but many of the most promising electronic, sensing, and biological applications of SWCNTs require electronically pure materials. For this process to work, we tailor the DEP force such that there is a significant difference in force between the particles of unique electronic structures. This difference in force can allow for a net difference in velocity leading to a physical separation of particles. The following outlines the basic theory and control parameters in order to optimize DEP forces to enable SWCNT separation according to an embodiment of the current invention.

The DEP force on a particle is given by $$F_{DEP} = C_{VP}\epsilon_m Re(K)\nabla E^2$$

$$K = \frac{\epsilon_p^* - \epsilon_m^*}{\epsilon_m^* + L(\epsilon_p^* - \epsilon_m^*)}$$

$$\epsilon^* = \epsilon - \frac{i\sigma}{\omega};\ L = \frac{\ln(l/r) - 1}{(l/2r)^2}$$

where $C_{VP}$ is a constant dependent on the particle geometry, $\in$ is the permittivity, $\sigma$ is the conductivity, l is the length of the particle, r is the radius of the particle. The subscript "m" refers to the medium in which a particle is suspended and the subscript "p" refers to the particle itself. E is the applied electric field and $\omega$ is the frequency of the applied field. K is known as the Clausius-Mossotti factor of an ellipsoid.

The steady-state velocity of a given particle in a medium due to a DEP force can be determined by equating the DEP force to a Stokes drag force. Stokes drag is appropriate because the small size of the particle leads to a very low Reynolds number.

$$F_{DEP} = 6\pi\mu v_p l$$

$$v_p = \frac{F_{DEP}}{6\pi\mu l}$$

where $\mu$ is the dynamic viscosity of the medium.

From this formulation, it is clear that the velocity of a given particle is directly proportional to the DEP force. Maintaining a difference in velocity between the metallic and semiconducting SWCNTs is what can allow for effective separation. Thus, in order to optimize separation, we maximize the difference in DEP force between metallic and semiconducting particles.

In order to optimize the difference in DEP force we focus here on optimizing the difference in Re(K) of the particles for a given medium. The permittivity and conductivity of the SWCNT particles are fixed as a function of their chirality and chemical environment. The radius is also fixed for a given chirality and the length is a function of the production parameters. For these calculations we assume the length and radius of all the particles are approximately the same because they were all manufactured as a single batch. This field can be designed by the device-specific geometry and amplitude of the AC electric field. Though the electric field can be tuned to get a larger net force, the particles in the suspending medium will all be exposed to the same electric field so we can treat it as a constant for this general approach. Thus maximizing the difference in Re(K) for the metallic and semiconducting particles will lead to a maximum in the difference in DEP force and particle velocity.

Figure 3:
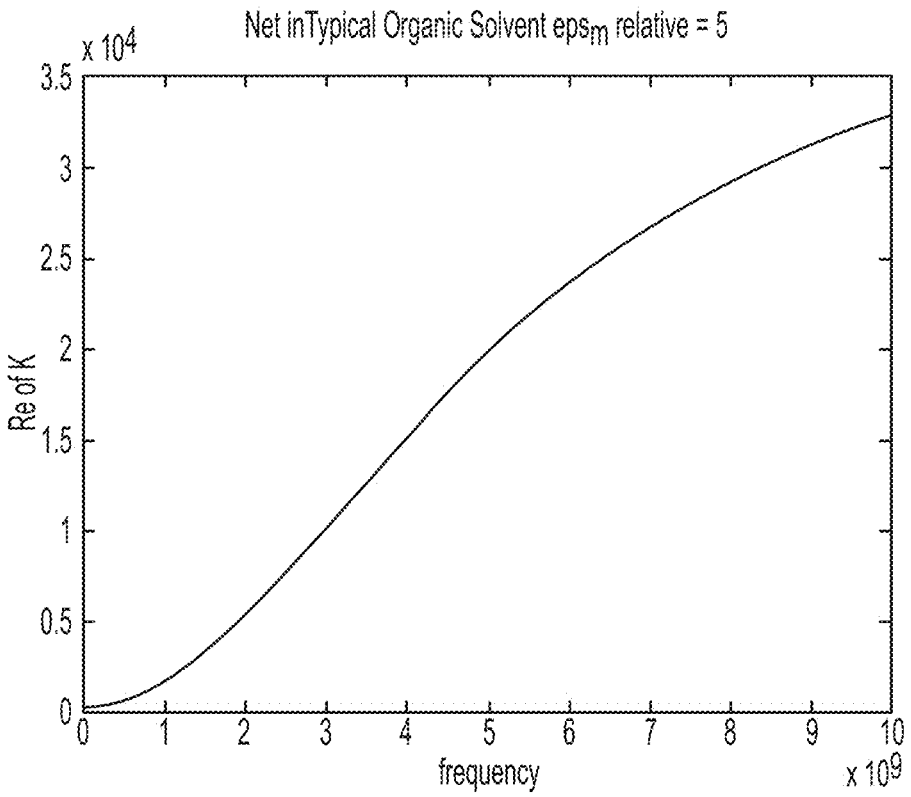
FIG. 3 shows difference in Re(K) versus frequency for typical organic solvents including benzene, chloroform, and chlorohexane for optimization of some embodiments of the current invention. These solvents typically have a relative permittivity of 5.
Figure 4:
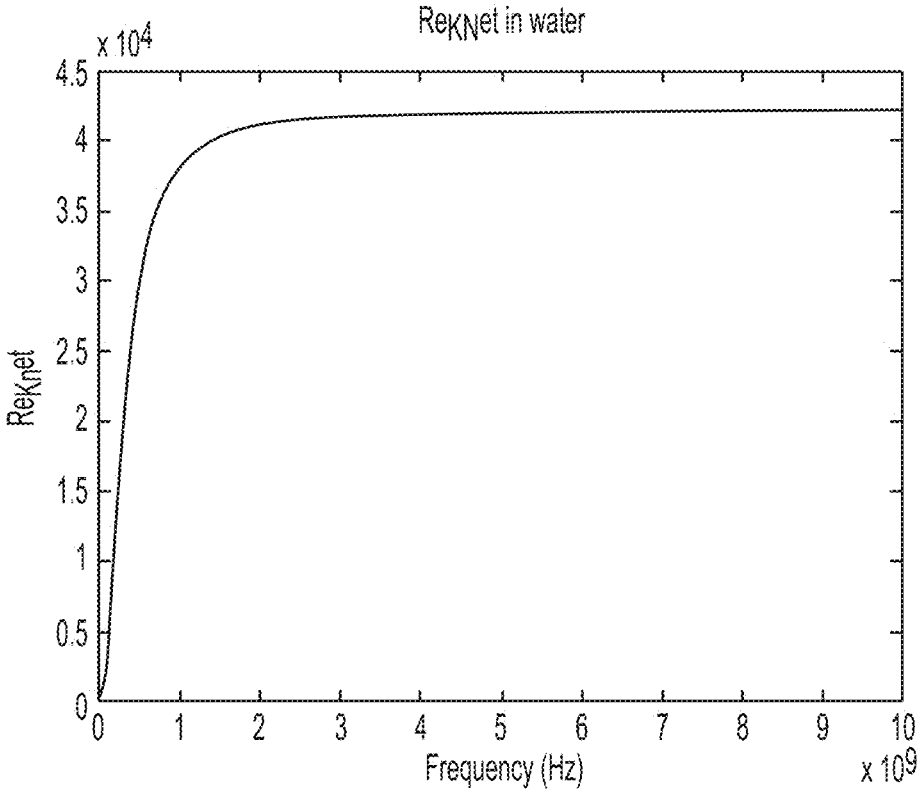
FIG. 4 shows difference in Re(K) versus frequency for water which has a relative permittivity of 80 for optimization of some embodiments of the current invention. This moderately high permittivity allows Re(K) to reach optimal values.
Figure 5:
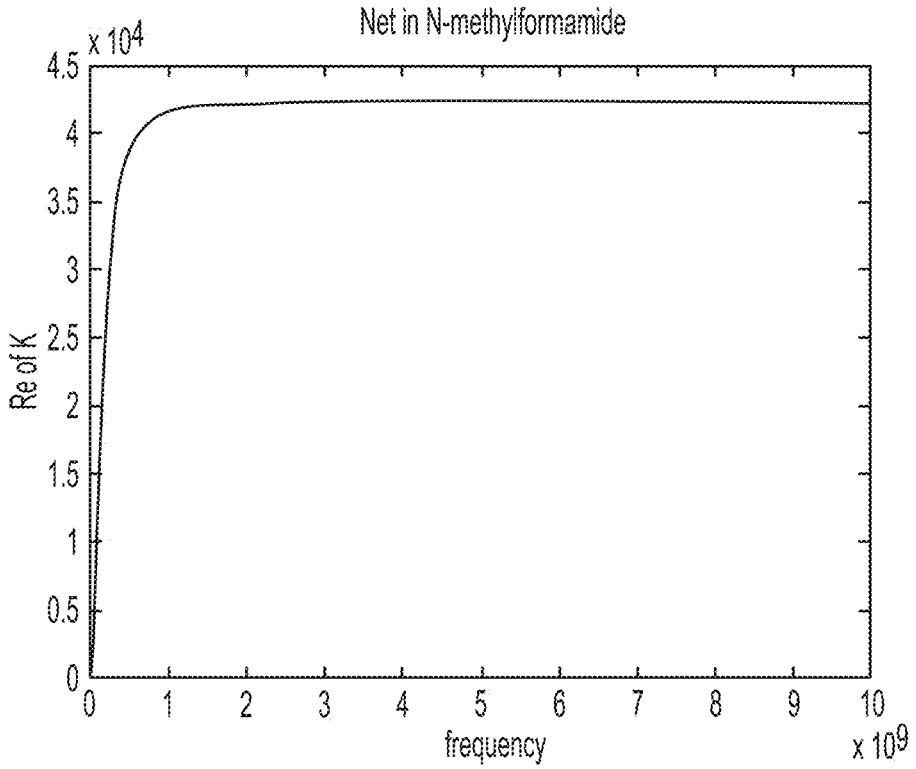
FIG. 5 shows difference in Re(K) versus frequency for N-Methylformamide which has a relative permittivity of 180 for optimization of some embodiments of the current invention. This high permittivity medium allows Re(K) to reach optimal values in the MHz regime.

FIGS. 3 through 5 show plots of the net difference in Re(K) as a function of frequency for common solvents with relative permittivities ranging from 5 to 180. These calculations assume a medium conductivity of $10^{-3}$ S/m which is typical given the surfactant concentration used to keep the SWCNTs in suspension.

TABLE 1

Representative frequencies for optimizing Re(K) in Common Solvents

| Medium | Relative Permittivity | Half Height Frequency | Asymptote Frequency |
|---|---|---|---|
| Org. Solvent (Benzene) | 5 | ~3.5 GHz | ~10 GHz |
| Water | 80 | ~0.3 GHz | ~2 GHz |
| N-Methylformamide | 180 | ~0.15 GHz | ~0.9 GHz |

Table 1 illustrates the frequencies at which the difference in Re(K) approaches useful values for the selected solvents. From these calculations it is clear that increasing the relative permittivity of the suspending medium allows for lower driving frequencies to reach optimal differences in Re(K). While these results apply for a broad range of permittivities in liquids, it may be possible to use other liquids with even higher permittivities or adjust the conductivity of the medium in order to further lower the driving frequency.

EXAMPLES

The following examples help explain some concepts of the current invention. The broad concepts of the current invention are not limited to only these particular examples, which are provided for explanation.

Single-walled carbon nanotubes (SWCNTs) purchased from Sigma-Aldrich (carbon >90%, ≥70% carbon as SWCNT) were used in this study. Suspensions were prepared by mixing 2 mg of raw SWCNTs roots in 20 ml deionized water with 1 wt. % of the surfactant sodium dodecyl sulfate (SDS) (99.0%, Sigma-Aldrich). The suspension was ultra-sonicated for 30 minutes and then centrifuged at 3000 rpm for 2 hours. The upper 80% of the suspension was taken to use in the experiment.

Static System

Figure 6A:
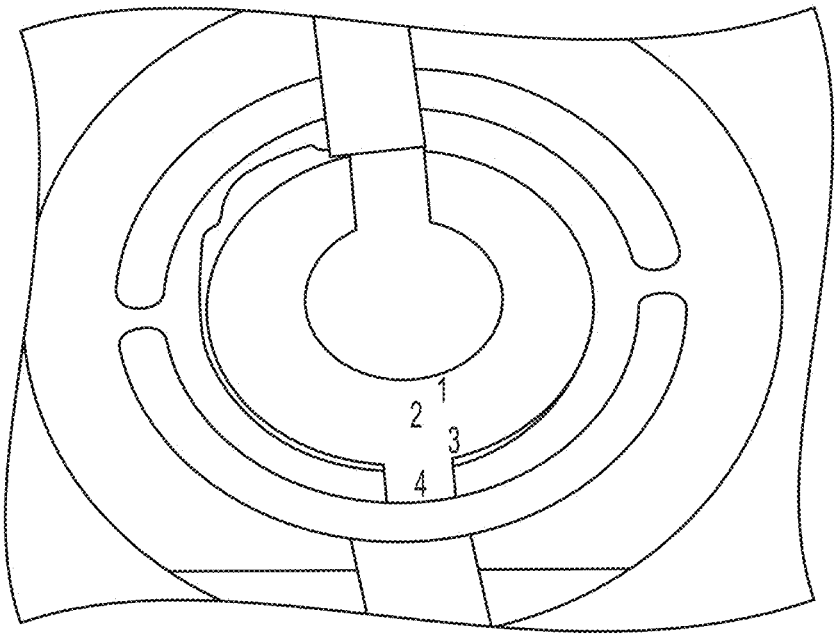
FIG. 6A shows an image of an electrode setup for separating metallic and semiconducting single-walled carbon nanotubes from a static fluid suspension according to an embodiment of the current invention. Raman spectra were taken using focused laser spots at positions 1-4 respectively.
Figure 6B:
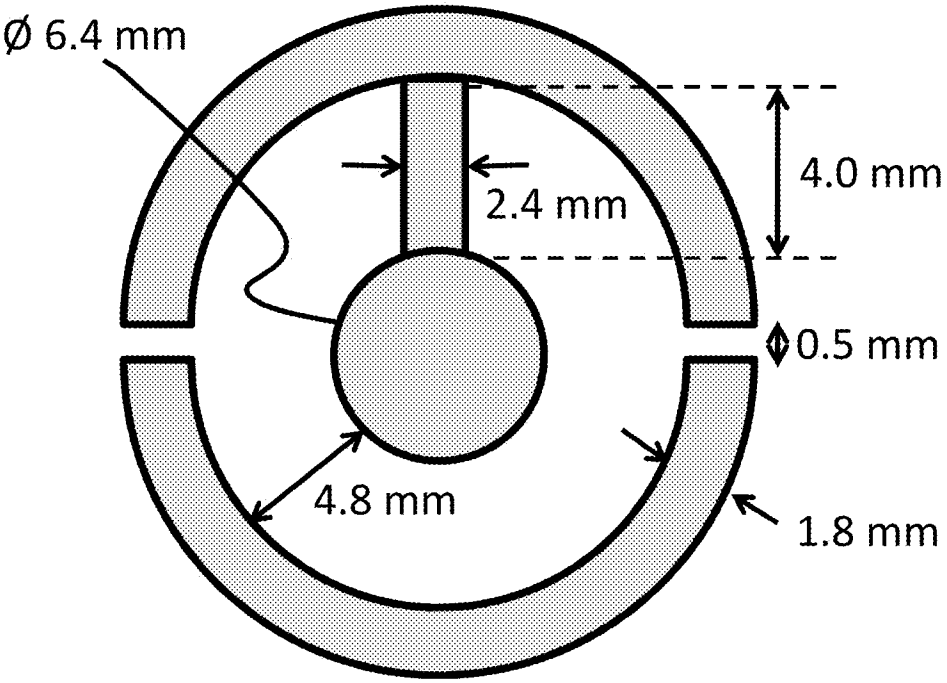
FIG. 6B provides an example of dimensions that can be used for the device of FIG. 6A.

To obtain the non-uniform electric field required for dielectrophoresis, a gold microelectrode (MaxTek, Inc. P/N 149272-1) composed of a circular inner electrode of radius of about 3.3 mm and a semicircular outer electrode of radius of about 9 mm as shown in FIG. 6A was used in the experiments. The electrodes provided a radial electric field gradient to establish a radially directed dielectrophoretic force. The SWCNTs separation device is connected to an HP E3617A DC power supply and Agilent Technologies 33120A 15 MHz function waveform generator. After the function generator was switched on, a drop of suspension (~100 μL) was released into the gap between the circular inner and semicircular outer electrodes.

The separation was operated at a frequency of 10 MHz and a peak-to-peak voltage of 10 $V_{p-p}$ between the two electrodes. After the voltage was applied, the suspension was allowed to rest and air dry for ~4 hours and samples were collected from each electrode. To confirm the segregation of metallic and semiconducting SWCNTs, resonant Raman spectroscopy was performed since the difference in optical properties between metallic and semiconducting SWCNTs allows the spectral peaks of each species in the Raman data to be resolved distinguishably[16]. The G-band and radial breathing mode (RBM) frequencies of metallic and semiconducting SWCNTs were identified using the $Ar^+$ ion laser excitation energy of 2.41 eV (514 nm). The Raman spectra at position 1 (SWCNTs are near the circular inner electrode) and position 4 (SWCNTs are near the semicircular outer electrode) were generated by Ocean Optics QE65000 spectrometer equipped with a Mitutoyo microscope and a thermoelectrically cooled CCD. The Raman spectra at position 2 (SWCNTs are about 5 μm away from the circular inner electrode) and position 3 (SWCNTs are about 300 μm away from the circular inner electrode) were generated by a HORIBA Scientific Raman system.

Figure 7:
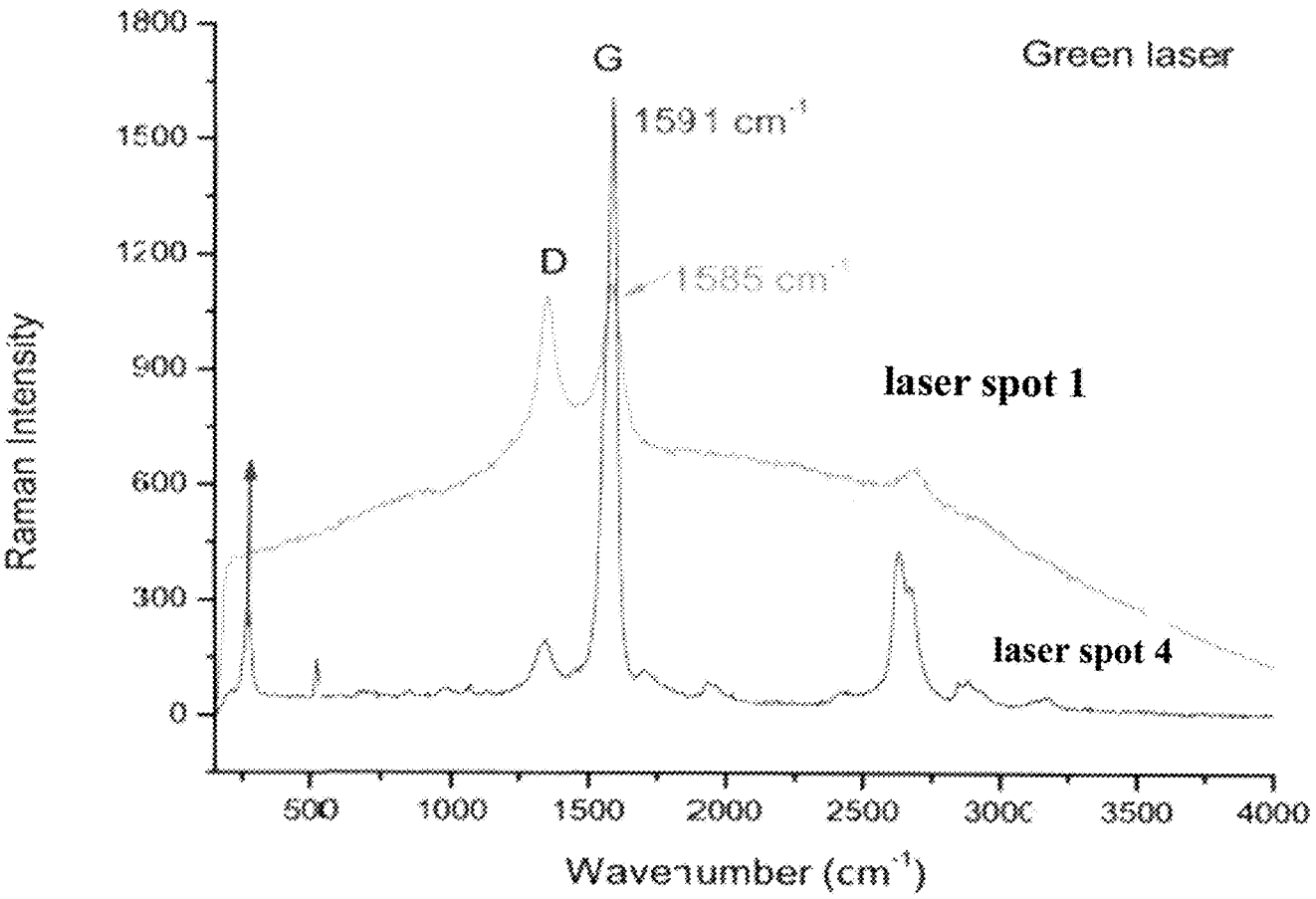
FIG. 7 shows Raman spectra of SWCNTs at position 1 and 4.
Figure 8:
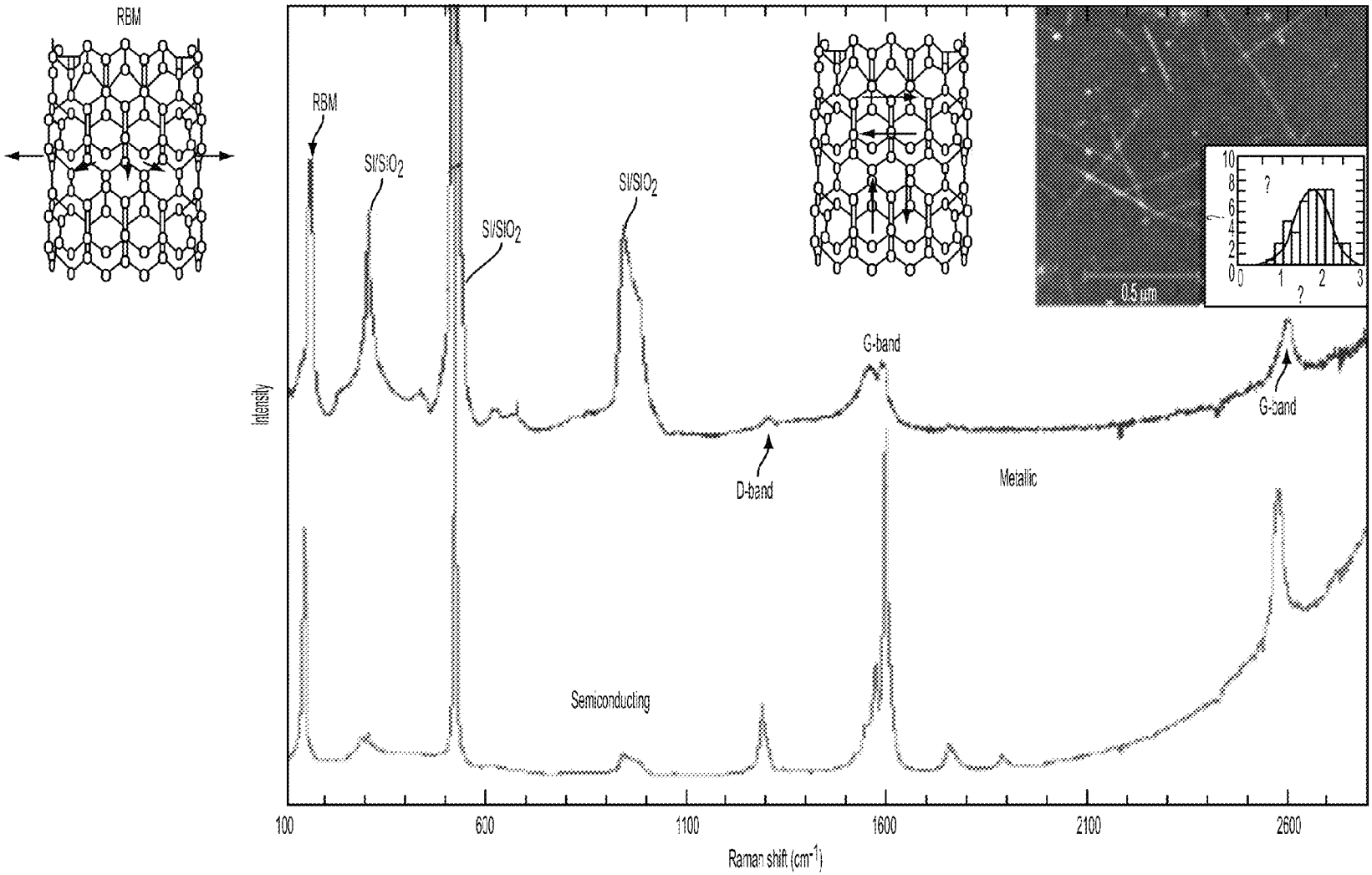
FIG. 8 shows full Raman spectra generated by Dresselhaus et al.[17-18].

FIG. 6A shows positions where Raman spectra were taken. Raman spectra of SWCNTs at position 1 and position 4 are shown in FIG. 7. Comparing the measured Raman spectra to reference Raman spectra shown in FIG. 8 generated by Dresselhaus et al., the spectra of the D and G bands from positions 1 and 4 matches well with the spectra for purified metallic tubes and purified semiconducting tubes respectively.

The radial breathing mode (RBM) region usually occurs at the frequencies of 100 to 350 $cm^{-1}$ for SWCNTs[17] and according to Dresselhaus et al., the RBM frequency, (ORBM, is linearly depended on the reciprocal of the carbon nanotube diameter, $d_t$[19-20]. In FIG. 7, for laser excitation energy of 2.41 eV (514 nm), the Raman spectra of SWCNTs near the semicircular outer electrode (position 4) show a sharp peak at 267 $cm^{-1}$. This peak indicates the possible presence of some metallic SWCNTS around the area despite the dominant semiconducting signal. The RBM frequencies of Raman spectra of SWCNTs observed here may be a result of the diameter of the tubes instead of indicating metallic properties.

G-band mode is related to vibrations in all $sp^2$ carbon materials. The characteristic Raman peak of the G-band mode corresponds to the electronic properties (semiconducting or metallic) of SWCNTs[24]. In general, shown in the reference Raman spectra in FIG. 8, the Raman spectra of semiconducting SWCNTs show a sharp peak at 1592 $cm^{-1}$ for the G-band mode, while metallic SWCNTs generate a broad peak at 1582 $cm^{-1}$ for the G-band mode[16-18,21,23-24]. The G-band mode signal of the tubes near the semicircular outer electrode (position 4) shows a sharp peak at 1591 $cm^{-1}$. The G-band mode signal of the tubes near the circular inner electrode area (position 1) shows a sharp peak at 1585 $cm^{-1}$. The SWCNTs at position 1 are metallic after the separation experiment. At position 4, the SWCNTs show semiconducting behavior, although with some possible metallic contamination in that region.

Figure 9:
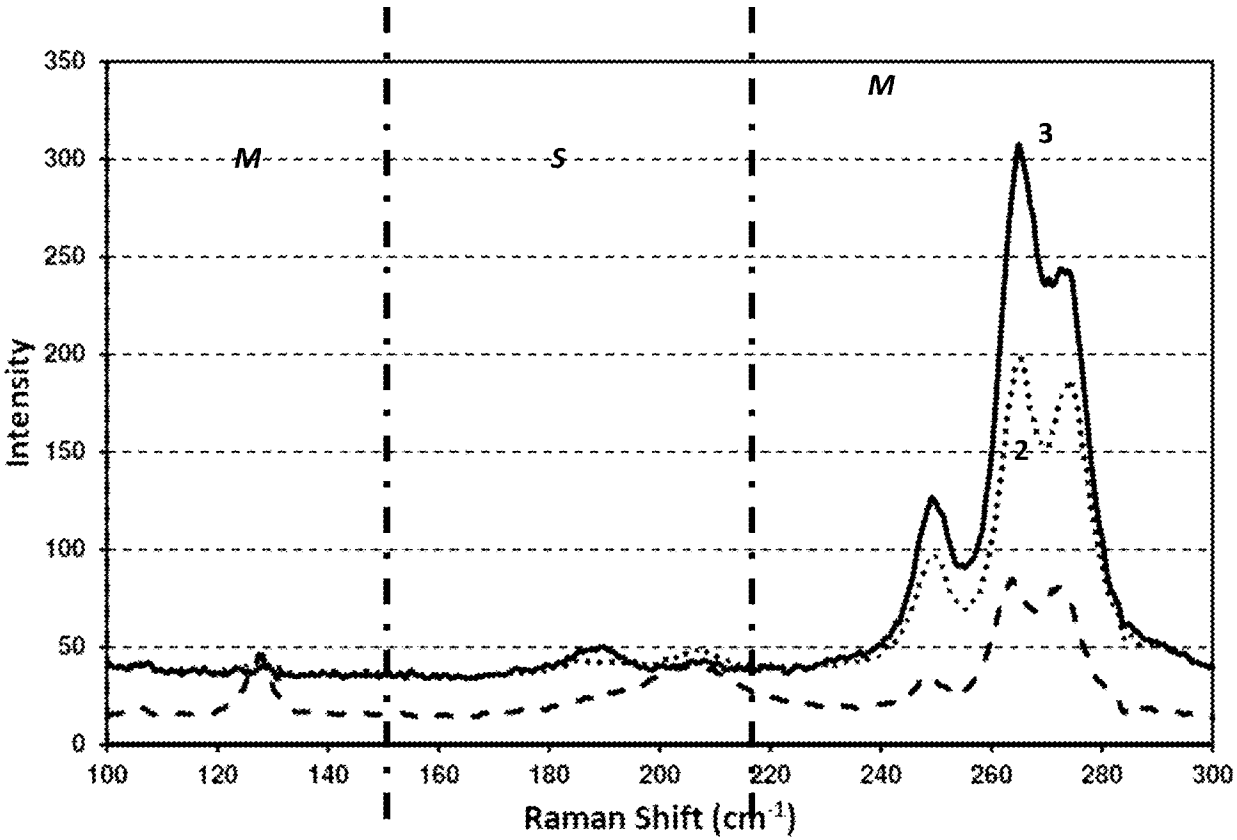
FIG. 9 shows Raman spectra of radial breathing mode (RBM) frequencies of SWCNTs using the laser excitation energy of 2.41 eV (514 nm) after the separation by AC dielectrophoresis. The round dotted line (middle) represents the RBM profile of the CNTs at position 2. The solid line (top) shows the RBM profile of the CNTs at position 3. The black dashed line indicates the control sample of mixed SWCNTs before the separating experimentation.
Figure 10:
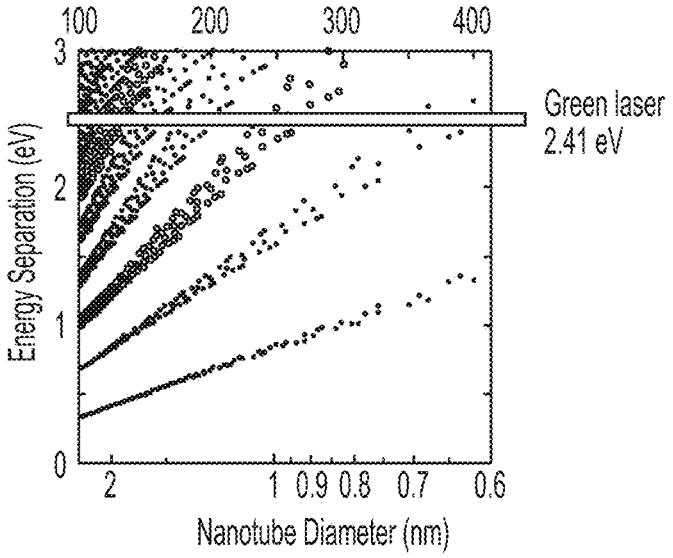
FIG. 10 shows the Katauru plot for the laser excitation energy of 2.41 eV (514 nm)[22].

FIG. 9 shows Raman spectra of RBM frequencies of SWCNTs that are about 5 μm away from the circular inner electrode (position 2), and about 300 μm away from the circular inner electrode (position 3). We distinguish between the metallic and semiconducting SWCNTs by their corresponding RBM frequencies. According to the Katauru plot shown in FIG. 10, for the laser excitation energy of 2.41 eV (514 nm), the RBM frequencies of semiconducting SWCNTs are in the range of about 175 to 213 $cm^{-1}$, and the RBM frequencies of the metallic SWCNTs are at about 120 to 150 $cm^{-1}$ and 218 to 280 $cm^{-1}$[1,3,16,21-22].

Shown in FIG. 9, two peaks at 127 $cm^{-1}$ and 208 $cm^{-1}$ and a double peak at 263 $cm^{-1}$ and 271 $cm^{-1}$ are shown in the RBM spectra. These peaks indicate the mixed metallic and semiconducting electronic types of SWCNTs in the reference sample before the separation. A peak at 249 $cm^{-1}$ and a dominant double peak at 264 $cm^{-1}$ and 275 $cm^{-1}$ appear in the RBM spectra for the tubes at position 2. A peak at 249 $cm^{-1}$ and a sharp double peak at 265 $cm^{-1}$ and 273 $cm^{-1}$ appear in the RBM spectra for the tubes at position 3. With the peak information in the RBM range compared to the Katauru plot shown in FIG. 10, the strongly dominant intensity of RBM frequency in the range between 218 to 280 $cm^{-1}$ shows that SWCNTs at position 2 and position 3 are significantly purified metallic behaviors.

Using a DEP force, the metallic SWCNTs were separated from the mixture and drawn towards the circular inner electrode, while the semiconducting ones were driven toward the semicircular outer electrode under the action of an AC field. This indicated that the metallic SWCNTs experienced positive DEP force and were attracted to the high field density area when the dielectric constant of the medium (1 wt. % SDS solution) is ~80[5]. On the other hand, the low dielectric constant of semiconducting SWCNTs (<5)[5] experienced a negative DEP force, causing them to move toward the low electric field density region. In this case, the higher electric field density occurs at the region of circular inner electrode, and the lower one happens at the region of semicircular outer electrode.

Dynamic Flow System

Figure 11:
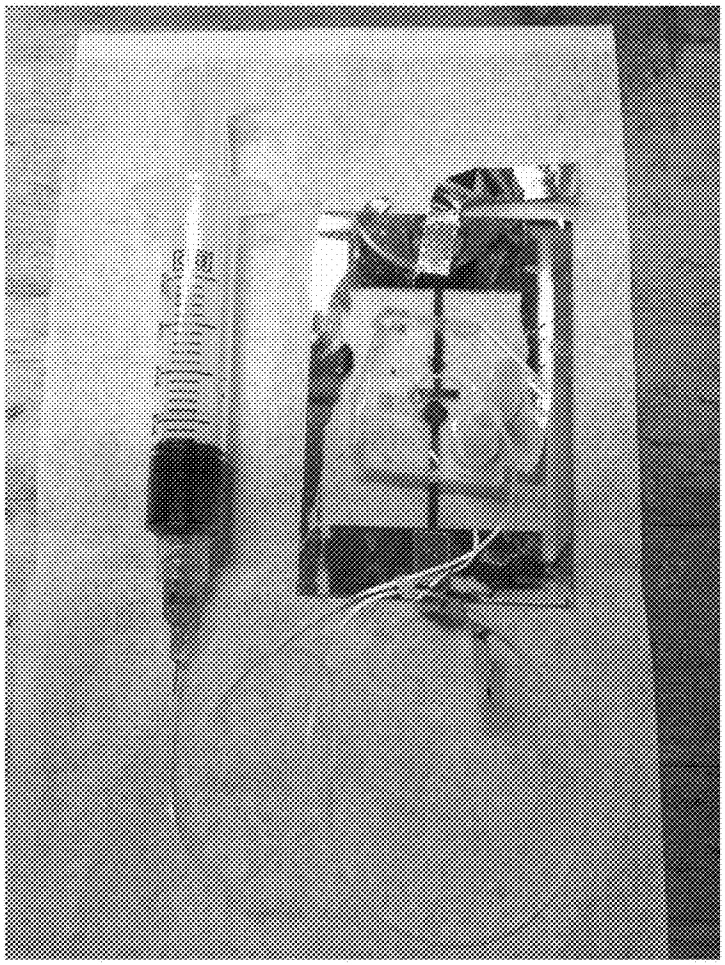
FIG. 11 shows a DEP-driven lab-on-a-chip device to continuously separate and collect metallic and semiconducting SWCNTs according to an embodiment of the current invention.

A microfluidic lab-on-a-chip device is a reliable lab instrument used to continuously separate nanoparticles or cells by AC dielectrophoresis. This example now focuses on fabricating a dielectrophoretic (DEP) force utilized microfluidic lab-on-a-chip device that can continuously separate and collect a large quantity (at mg level) of metallic and semiconducting SWCNTs by AC dielectrophoresis as shown in FIG. 11. Adapting the successful results on separating two types of SWCNTs, the gradient of the electric field can be generated by the non-uniform shape of the electrodes as shown in FIG. 11. The fabrication of the device involves two parts: the Au electrodes and microfluidic channels. A standard photolithography process on a Corning glass substrate can pattern Au electrodes. The chamber and microfluidic channels can be made by an insulating material, polydimethylsiloxane (PDMS), on the Corning glass substrate and the Au electrodes by standard microfabrication techniques. An automated syringe pump can control the flow rate of the stream of mixed SWCNTs into the microfluidic channels.

The method to separate metallic SWCNTs from semiconducting ones in a mixture of SWCNTs in suspension based on AC dielectrophoresis was demonstrated in the above examples. Applying this technique, metallic SWCNTs were effectively separated from semiconducting ones due the different magnitude of dielectrophoretic forces experienced in the suspension between these two types. The significant force difference comes from a very large absolute dielectric constant of metallic CNTs and the low value of a finite dielectric constant of semiconducting CNTs[3]. It was discovered that the repulsive effect between positive and negative DEP forces is the strongest in the center portion between the circular inner electrode and semicircular outer electrode. As a result, ultra-pure separation between metallic and semiconducting SWCNTs can be achieved.

REFERENCES

1. P. Avouris, *Physics World* 20, 40-45 (March 2007).
2. P. Avouris and J. Appenzeller, *The Industrial Physicist*, June/July 2004, American Institute of Physics.
3. R. Krupke et al., *Science* 301, 344-347 (2003).
4. N. Peng et al., *J. Appl. Phys.* 100, 024309 (2006).
5. R. Krupke et al., *Nano Lett.* 3, 1019-1023 (2003).
6. T. Tanaka et al., *Appl. Phys. Expr.* 1, 114001 (2008).
7. M. S. Dresselhaus, G. Dresselhaus and M. Pimenta, *Eur. Phys. J.* D 9, 69-75 (1999).
8. H. A. Pohl, *Dielectrophoretic*, Cambridge, UK (1978).
9. J. E. Kim and C. S. Han, *Nanotechnology* 16, 2245-2250 (2005).
10. N. Peng et al., *J. Appl. Phys.* 100, 024309 (2006).
11. T. Lutz and K. J. Donovan, *Carbon* 43, 2508-2513 (2005).
12. C. Wei et al., *Diamonds and Related Materials* 19, 573-577 (2010).
13. U. C. Wejinya et al., 2007 IEEE/ASME International Conference on Advanced Intelligent Mechatronics. pp 1-6 (2007).
14. H. Morgan and N. G. Green, *J. Electrostatics* 42, 279-293 (1997).
15. H. Morgan and N. G. Green, AC Electrokinetics: Colloids and Nanoparticles, Research Studies Press Ltd, 2003.
16. D. S. Lee et al., *Appl. Phys. A* 80, 5-8 (2005).
17. A. Jorio et al., *Phys. Rev. Lett.* 86, 1118-1121 (2001).
18. Mildred S. Dresselhaus, *Raman Scattering in Carbon Nanotubes* (2005). Website: nanotube.msu.edu/nt05/abstracts/NT05tutor-Dresselhaus.pdf
19. M. S. Dresselhaus and P. C. Eklund, *Adv. Phys.* 49, 705-814 (2000).
20. M. S. Dresselhaus et al., *Carbon* 40, 2043-2061 (2002).
21. J. L. Sauvajol et al., *Carbon* 40, 1697-1714 (2002).
22. Website: http://www.photon.t.u-tokyo.ac.jp/~maruyama/kataura/kataura2n.pdf
23. M. A. Pimenta et al., *Phys. Rev. B* 58, R16016-16019 (1998).
24. M. S. Dresselhaus et al., *Physics Reports* 409, 47-99 (2005).
25. Fan, D. L., Zhu, F. Q., Xu, X., Cammarata, R. C. & Chien, C. L. Electronic properties of nanoentities revealed by electrically driven rotation. *Proceedings of the National Academy of Sciences of the United States of America* 109, 9309-13 (2012).

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A continuous-flow method for separating metallic and nonmetallic particles from a mixed-particle suspension, comprising:

providing an input flow of a mixed-particle fluid suspension in a single input channel, said single input channel being bifurcated into first and second output channels at a bifurcated junction;

determining a time variation of a spatially-gradient and time-varying electric field to impose dielectrophoretic forces on metallic and nonmetallic particles in said mixed-particle suspension, wherein said determining takes into account a shape of said metallic and nonmetallic particles and a shape factor of said metallic and nonmetallic particles is determined according to $$L = \frac{\ln\left(\frac{l}{r}\right) - 1}{\left(\frac{1}{2r}\right)^2}$$

where l is a length of the metallic or nonmetallic particles and r is a radius of the metallic or nonmetallic particles;

applying said spatially-gradient and time-varying electric field to said input flow of said mixed-particle fluid suspension in said single input channel to impose said dielectrophoretic forces on said metallic and nonmetallic particles in said mixed-particle fluid suspension; and collecting a metallic-particle rich fluid suspension from said first output channel and a nonmetallic-particle rich fluid suspension from said second output channel, wherein said spatially-gradient and time-varying electric field is further determined to have a time variation such that a dielectrophoretic force imposed on said metallic particles is different from a dielectrophoretic force imposed on said nonmetallic particles, and wherein said spatially-gradient and time-varying electric field is determined to have a time variation of at least 150 MHz.

2. A continuous-flow method according to claim 1, wherein said spatially-gradient and time-varying electric field is further determined to have a time variation such that said dielectrophoretic force imposed on said metallic particles is opposite in direction to said dielectrophoretic force imposed on said nonmetallic particles.

3. A continuous-flow method according to claim 1, wherein a fluid of said mixed-particle fluid suspension is selected based on at least one of an electrical permittivity or electrical conductivity thereof.

4. A continuous-flow method according to claim 1, wherein a fluid of said mixed-particle fluid suspension is produced to have at least one of a selected electrical permittivity or electrical conductivity.

5. A continuous-flow method according to claim 1, wherein said nonmetallic particles are semiconducting particles.

6. A continuous-flow method according to claim 1, wherein said metallic particles are metallic carbon nanotubes, and wherein said nonmetallic particles are semiconducting carbon nanotubes.

7. A continuous-flow method according to claim 1, further comprising:

applying a second spatially-gradient and time-varying electric field to at least one of said metallic-particle rich fluid suspension in said first output channel or said nonmetallic-particle rich fluid suspension from said second output channel prior to said collecting as a second stage in a multistage method for separating metallic and nonmetallic particles.

8. A continuous-flow method according to claim 1, wherein said shape factor is greater than zero.

9. A continuous-flow method according to claim 1, wherein said determining said time variation of said spatially-gradient and time-varying electric field further comprises taking into account a frequency defined as $$\omega = \sqrt{\frac{\sigma_p\sigma_m + L\sigma_p^2 - \sigma_m^2}{\epsilon_m^2 - \epsilon_p\epsilon_m - L\epsilon_p^2}},$$

where $\in$ is a permittivity, $\sigma$ is a conductivity, and L is a shape factor, and where the subscript m refers to a fluid in which said metallic and nonmetallic particles are suspended, and the subscript p refers to a metallic or nonmetallic particle.

10. A continuous-flow method according to claim 1, wherein said spatially-gradient and time-varying electric field is further determined to have a time variation such that said difference between dielectrophoretic forces imposed on said metallic and said nonmetallic particles is maximized.

11. A continuous-flow method according to claim 1, wherein said time variation of said spatially-gradient and time-varying electric field is further determined based on a conductivity of said nonmetallic particles.

12. A continuous-flow method according to claim 11, wherein said conductivity of said nonmetallic particles is greater than 0.

13. A continuous-flow method according to claim 11, wherein said conductivity of said nonmetallic particles is at least $10^4$ Siemens/meter.

14. A continuous-flow method according to claim 1, wherein said spatially-gradient and time-varying electric field is determined to have a time variation of at least 300 MHz.

15. A continuous-flow method according to claim 1, wherein said spatially-gradient and time-varying electric field is determined to have a time variation of at least 3.5 GHz.

* * * * *